United States Patent [19]

Schuh et al.

[11] 4,095,737

[45] Jun. 20, 1978

[54] TAXIMETER AND MOUNTING ARRANGEMENT

[75] Inventors: Eduard Schuh; Hans-Peter Scholl, both of Villingen, Germany

[73] Assignee: Kienzle Apparate GmbH, Villingen-Schwenningen, Germany

[21] Appl. No.: 702,275

[22] Filed: Jul. 2, 1976

[30] Foreign Application Priority Data

Jul. 8, 1975 Germany ..... 2530390

[51] Int. Cl.[2] ..... G07B 13/00; G07B 15/00

[52] U.S. Cl. ..... 235/30 R; 235/29 A

[58] Field of Search ..... 235/29 A, 30 R, 33, 235/45

[56] References Cited

U.S. PATENT DOCUMENTS

| | | | |
|---|---|---|---|
| 563,289 | 7/1896 | Logan | 235/29 A |
| 1,275,185 | 8/1918 | Kurowski | 235/30 R |
| 2,596,164 | 5/1952 | Palmer | 235/30 R |
| 2,616,622 | 11/1952 | Miller | 235/30 R |

*Primary Examiner*—Stephen J. Tomsky
*Attorney, Agent, or Firm*—Michael J. Striker

[57] ABSTRACT

A taximeter housing is securable to a vehicle part in such a manner that only two seals are required to prevent unauthorized tampering with the input connections, the interior components of the taximeter and the taximeter mount, and that only a single seal need be broken when it is necessary to gain access to the interior components to readjust the taximeter for a tariff change.

3 Claims, 3 Drawing Figures

FIG. 1
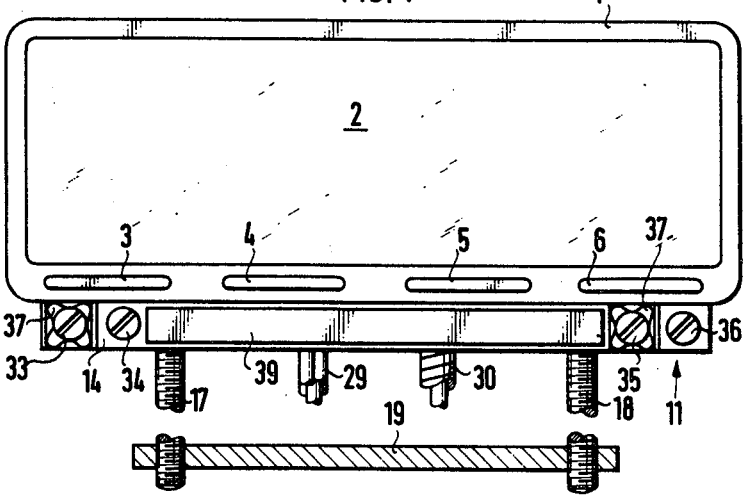
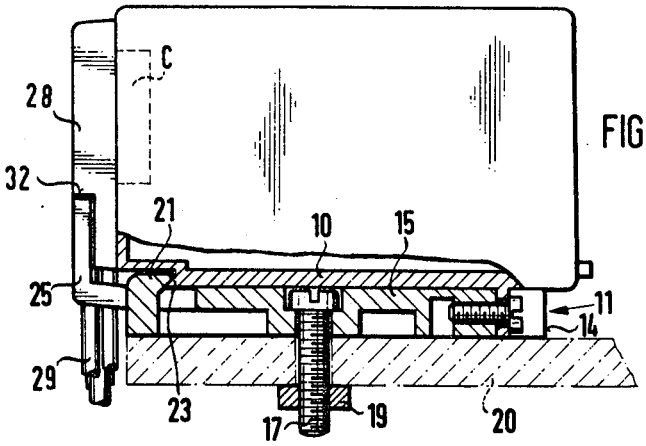
FIG. 2

TAXIMETER AND MOUNTING ARRANGEMENT

BACKGROUND OF THE INVENTION

This invention relates to a taximeter and mounting arrangement.

In known mechanical taximeters it is necessary to apply anti-tampering seals at three places of the apparatus. Any cables entering the taximeter housing, especially the flexible mechanical shaft for transmitting the information concerning distance travelled as well as electrical cables for supplying the taxi roof sign with current or for providing the electrical connection between the current supply and the taximeter must be fastened to the apparatus in such a way that the entry point can be provided with a seal, usually a lead seal, to prevent tampering. A second such seal is used to secure the housing of the taximeter, i.e., to prevent unauthorized access to the interior of the housing. Finally, a third seal is required for the fastening of the taximeter to the vehicle.

Every time the tariff in a mechanical taximeter is to be changed — and this happens rather frequently — it is necessary to exchange gear or to carry out other modifications in the apparatus. This means that for each tariff change the apparatus must be taken out of the vehicle in order to effect the adaptation in the workshop. Thereafter, the apparatus must be remounted and sealed again at all three points after checking by the appropriate supervisory, e.g. the division of weights and measures. Needless to say, all of this involves considerable service expenses so that any tariff change is a very costly matter for the taxi owner.

This, of course, is an important argument for using an electronic taximeter, although these are still somewhat more expensive than mechanical ones, since such electronic taximeters generally may be adjusted to work on different tariffs in a much simpler manner.

In designing an electronic taximeter it must therefore be kept in mind that it should be possible to permit any tariff modifications to be carried out in a simple and quick manner and with the least possible expenditure for services. To achieve this it is essential that such tariff changes can be carried out without having to dismount the taximeter from the vehicle. This would require that in the event of a tariff modification the various cables, whether it be a mechanical or electrical cable, should no longer have to be decoupled from the taximeter. Also, the seal by means of which the taximeter is secured in the vehicle should remain untouched when the tariff is changed. Ideally, only a single seal should have to be destroyed, that seal which secures the taximeter housing against being opened.

SUMMARY OF THE INVENTION

Accordingly, it is an object of the invention to afford the desired advantages and overcome the drawbacks of the prior art.

A more particular object of the invention is to provide an improved taximeter and mounting arrangement wherein tariff changes require only the destruction and subsequent reapplication of a single seal.

Another object of the invention is to provide such a taximeter wherein the seal to be destroyed for purposes of making tariff adjustments is the seal which prevents unauthorized opening of the taximeter housing.

Care must, of course, be taken to assure that the taximeter is mounted in a vehicle in such a manner that the mechanical and/or electrical cables can be detached only when the taximeter is also to be fully disconnected from the vehicle.

Briefly stated, the device according to the invention comprises a mounting plate to be retained in the vehicle and cooperating with the base plate of a taximeter housing having correspondingly shaped projections for securing the position of the taximeter in two dimensions before being sealed, the mounting plate being provided with projections surmounting the dimensions of the base plate and protruding above the plane of the base plate. Such projections are essentially bent at right angles to the plane of the mounting plate and grip a cover plate which secures the mechanical and/or electrical connections.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a front view of a taximeter and its fastening device according to the invention;

FIG. 2 is a side view of the device of FIG. 1, partially in vertical section and looking to the right in FIG. 1.

DESCRIPTION OF THE PREFERRED EMBODIMENT

Figure 3:
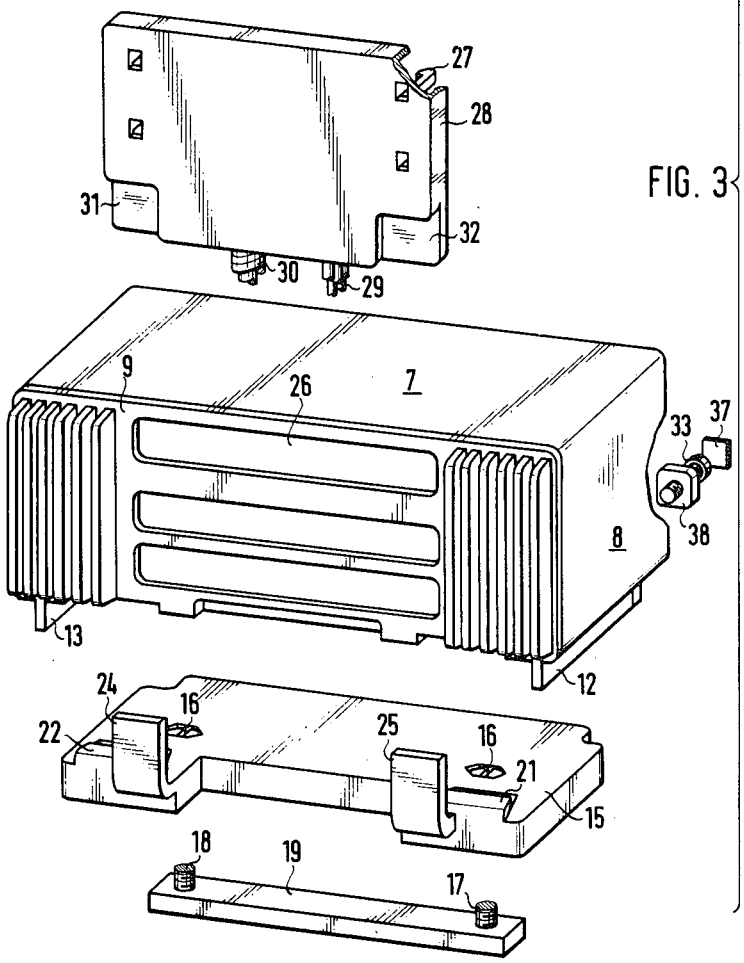
FIG. 3 is an exploded view showing the parts of the invention.

The taximeter housing 1 is provided with a front window 2. Below the front window 2 operating buttons 3, 4, 5 and 6 extend through apertures in the housing 1 and serve to actuate the taximeter components, especially to control the various functions of the apparatus. It should be understood that the internal circuitry of this (electronic) taximeter forms no part of the invention and is not required to be disclosed herein for an understanding of the invention. Apart from the transparent front window 2 the housing 1 has a top wall 7, two opposite side walls 8, a rear wall 9 and a bottom wall or base plate 10. The base plate 10 of the housing 1 is provided with a downwardly projecting lip or projection 11 having the two lateral parts 12 and 13 (see FIG. 3) and a front part 14 which connects the parts 12, 13 (see FIGS. 1 and 2).

The projection 11 serves to fasten the taximeter in the vehicles and for this purpose cooperates with a mounting plate 15 which is fixedly mounted in the vehicle. The mounting plate 15 has outer dimensions which matingly correspond to the space surrounded by the projection 11 on the taximeter base plate 10. In other words, the two lateral edges and the front edge of the mounting plate 15 serve as a guide to the taximeter in that they exactly fit into the space within the projection 11 on the taximeter base plate 10 when the housing with its plate 10 is pushed over the plate 15. The mounting plate 15 is provided with holes 16 through which screws 17 and 18 may be inserted from above to secure the plate 15 to a retaining plate 19. The screws 17 and 18 serve to fasten the mounting plate 15 to a console 20 which is part of the vehicle in which the taximeter is to be installed. The console 20 is provided with holes through which the screws 17 and 18 extend and are threaded into tapped bores in retaining plate 19. Of course, the holes in console 20 could themselves be threaded and the screws 17, 18 be directly secured in them without the retaining plate 19. The mounting plate 15 cannot be removed from the console 20 as long as the taximeter in its installed condition covers the heads of screws 17 and 18 so that they cannot be loosened.

At its rearwardly facing edge the mounting plate 15 is provided with two dovetail-shaped projections 21 and 22. These projections 21, 22 cooperate with two similarly shaped projections 23 on the taximeter base plate 10. In addition, the mounting plate 15 is provided with projections 24, 25 which extend from the mounting plate 15 and are bent upwardly essentially at right angles to the plane of plate 15. The rear wall 9 of the taximeter housing is provided with cut-outs 26 through which multi-terminal connectors C may be introduced (are shown diagrammatically in FIG. 2). These connectors are introduced into sockets provided in the taximeter housing 1, but not shown. The connectors C are retained by clamps 27 on a cover plate 28 which is to be secured to the rear wall 9 of the taximeter housing 1 so that the connectors may be introduced into the sockets through the cut-outs 26. The cover plate 28 has openings at its lower rim for introducing, respectively leading out, the mechanical respectively electrical cables 29 and 30. At its lower respectively its lateral edge region the cover plate 28 is provided with recesses 31 and 32.

When the cover plate 28 is fastened to the rear wall 9 of the taximeter housing 1 by introducing the connectors C into the sockets, the apparatus is connected to the current supply, to the distance-indicating drive, and also to the various visual signs, such as the taxi roof signs. The cables 30 and 29 can no longer be detached by pulling out the connectors C, as soon as the cover plate 28 has been secured to the taximeter housing 1, as will now be described.

When the taximeter housing 1 with the cover plate 28 and the cables 30 and 29 connected thereto is pushed over the mounting plate 15, the two lateral parts 12 and 13 of the projection 11 on the base plate 10 guide the taximeter until the projections 23 engage with the projections 21 and 22 on the mounting plate (see FIG. 2). The taximeter housing 1 is thus blocked against movement in all directions except in the direction opposite to the direction in which it has just been inserted. In this position the projections 24 and 25 have entered the recesses 31 and 32 on the cover plate 28. This means that the cover plate 28 can not be removed any more from the taximeter housing 1 without removing the taximeter housing itself from the mounting plate 15. By means of the mounting plate 15 is the projection 11, as well as the projections 24 and 25 of the taximeter housing 1 with the cover plate 28, are thus fixed in their position so that only a single lead seal is required to secure this position against tampering.

FIGS. 1 and 2 show how this is done: FIG. 1 shows four screws 33, 34 35 and 36 of which the screws 34 and 35 serve to close the housing, i.e., to secure the front part of the housing to the remainder of the housing (these two parts have not been shown separately in the drawing). The screws 33 and 36 extend through the projection 11 and fasten the housing 1 to the mounting plate 15. Only the screw 33 which serves to fasten the housing in the vehicle, and the screw 35 which serves to connect the two housing parts together, need to be provided with anti-tampering lead seals 37 which are inserted into respective sealing cups 38.

Thus, as clearly seen in FIG. 1, only two seals are required for the taximeter to be completely secured. When the tariff is to be changed just one of the seals, namely that seal which secures the screw 35 need be broken in order to open the taximeter housing to permit the setting of the interior taximeter components to the new tariff in the fare calculating device.

Only when repairs are to be carried out is it necessary to break the seal 37 of screw 33 in order to take the taximeter off its mounting plate 15 and thereby also out of the vehicle. The electrical and mechanical cables on plate 28 require no seal whatever, but yet are absolutely reliably secured against any unauthorized tampering. If desired, an identification plate 39 may be applied at the front part 14 of the projection 11.

It will be understood that each of the elements described above, or two or more together, may also find a useful application in other types of applications differing from the types described above.

While the invention has been illustrated and described as embodied in an electronic taximeter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a taximeter, a combination comprising a housing having a rear wall and a bottom wall projecting forwardly from said rear wall and having a rear edge portion and two lateral edge portions; a cover plate having a surface adapted to attach to said rear wall and provided with connector means adapted to engage with corresponding means in said housing; a mounting plate having a front end and a rear end and including mounting means for permanently installing said mounting plate in a vehicle; first interengaging portions on said mounting plate and bottom wall, comprising projections extending downwardly from said lateral edge portions of said bottom wall and straddling opposite lateral edges of said mounting plate when said housing is pushed over said mounting plate in one direction from said front edge towards said rear edge thereof so that said housing is thereafter blocked against movement relative to said mounting plate in all directions except counter to said one direction; and second interengaging portions on said mounting plate and cover plate, including upstanding projections extending upwardly from said rear edge of said mounting plate and engaging behind said cover plate at a side thereof which faces away from said rear wall, so as to prevent detaching of said cover plate from said rear wall when said housing is supported on said mounting plate and while said first interengaging portions remain engaged with one another.

2. A combination as defined in claim 1, wherein said first portions include a section extending across a front side of said housing and provided with holes, and further comprising screws threaded through said holes into tapped bores of said mounting plate, at least one of said screws having a head provided with a lead seal which cannot be removed without destroying the lead seal and thereby indicating unauthorized tampering.

3. A combination as defined in claim 1, wherein said mounting plate has an upper side facing said bottom wall and a lower side adapted to face a component of a vehicle, and screws extending from said upper side through said mounting plate past said lower side and anchoring said mounting plate to said component, said screws being inaccessible for removal when said housing is supported on said upper side of said mounting plate.

* * * * *